US009751001B1

(12) United States Patent
Vogel

(10) Patent No.: US 9,751,001 B1
(45) Date of Patent: Sep. 5, 2017

(54) EZ SCRATCH SYSTEMS

(71) Applicant: John Vogel, Lindenhurst, NY (US)

(72) Inventor: John Vogel, Lindenhurst, NY (US)

( * ) Notice: Subject to any disclaimer, the term of this patent is extended or adjusted under 35 U.S.C. 154(b) by 270 days.

(21) Appl. No.: 14/678,859

(22) Filed: Apr. 3, 2015

(51) Int. Cl.
*B08B 3/00* (2006.01)
*A63F 3/06* (2006.01)

(52) U.S. Cl.
CPC ..... *A63F 3/068* (2013.01)

(58) Field of Classification Search
CPC .. B08B 13/00; A63F 3/068; A63F 2011/0037; B26B 3/08; A47L 25/00
USPC ..... 134/93; 15/236.01
See application file for complete search history.

(56) References Cited

U.S. PATENT DOCUMENTS

| | | | |
|---|---|---|---|
| 7,712,179 | B2 | 5/2010 | Lemke |
| 2002/0152572 | A1 | 10/2002 | Steinmetz et al. |
| 2009/0300921 | A1 | 12/2009 | Strickman et al. |

*Primary Examiner* — Eric Golightly
(74) *Attorney, Agent, or Firm* — RG Patent Consulting, LLC; Rachel Gilboy

(57) ABSTRACT

A tool for scratching a lottery ticket scratch-off system includes a tool for scratching a lottery ticket scratch-off assembly having a downwardly-tapered front surface having a front top portion including an upwardly-curved lip, and at least one aperture, a front central portion having a digit-contoured indented center having at least one light, and a tapered front bottom portion having at least one front-side tapered blade; and a downwardly-tapered back surface having a back top portion, a back central portion, and a tapered back bottom portion having at least one back-side tapered blade.

19 Claims, 5 Drawing Sheets

EZ SCRATCH SYSTEMS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of lottery ticket scratcher devices and more specifically relates to a tool for scratching a lottery ticket scratch-off system.

2. Description of the Related Art

For tens of millions of Americans working away at their jobs and seeing the days, weeks, and years fly by, playing the lottery provides a real chance, however remote, of striking it rich. Playing the lottery provides a chance to dream. When we purchase a ticket in our state lottery, whether the big-money, multi-state games, or a scratch-off ticket, we know full well that our chance of winning the jackpot is roughly the same as our chance of getting struck by a meteorite, but we play, week in and week out, and take our chances. A lottery ticket in the pocket is a ticket to dream. Office workers who pool their resources and buy their weekly tickets together can dream of the day the boss walks in and finds them all gone; the man who hates his work buys his ticket and dreams of striking it rich, leaving his unsatisfying life behind, and spending his days fishing for blue marlin and his nights enjoying pina coladas at a tiki bar in the tropics.

With a scratch-off ticket, of course, our chances of winning something are better even if the mega-millions jackpot will not be our prize. And a scratch-off ticket lets us know, on the spot, whether we've won. All we have to do is scratch off the opaque film and check the numbers or symbols to see if we've won. For scratching off this film, most of us fish a penny or nickel out of our pocket or purse and scratch away a bit of a pain and a whole lot of scratching, since the edge of the coin makes such a narrow blade. A more efficient scratching means is desirable.

Various attempts have been made to solve problems found in lottery ticket scratcher device art. Among these are found in: U.S. Publication No. 2009/0300921 to Andrew Strickman et al; U.S. Publication No. 2002/0152572 to William L. Steinmetz et al; U.S. Pat. No. 7,712,179 to Patrick Timothy Lemke. This prior art is representative of lottery ticket scratcher devices. None of the above inventions and patents, taken either singly or in combination, is seen to describe the invention as claimed.

Ideally, a tool for scratching a lottery ticket scratch-off system would be user-friendly and safe in-use and, yet may operate reliably and be manufactured at a modest expense. Thus, a need exists for a tool for scratching a lottery ticket scratch-off system that is structured and arranged for quickly and cleanly scratching off an opaque film on scratch-off lottery tickets and to avoid the above-mentioned problems.

BRIEF SUMMARY OF THE INVENTION

In view of the foregoing disadvantages inherent in the known lottery ticket scratcher device art, the present invention provides a novel tool for scratching a lottery ticket scratch-off system (also referred to herein as 'EZ Scratch Systems'). The general purpose of the present invention, which will be described subsequently in greater detail is to provide a tool for scratching a lottery ticket scratch-off system that is structured and arranged for quickly and cleanly scratching off an opaque film on scratch-off lottery tickets.

A tool for scratching a lottery ticket scratch-off system is disclosed herein in a preferred embodiment comprising a tool for scratching a lottery ticket scratch-off assembly having a downwardly-tapered front surface having a front top portion including an upwardly-curved lip, and at least one aperture, a front central portion having a digit-contoured indented center having at least one light, and a tapered front bottom portion having at least one front-side tapered blade; and a downwardly-tapered back surface having a back top portion, a back central portion, and a tapered back bottom portion having at least one back-side tapered blade. The tool for scratching a lottery ticket scratch-off system comprises the tool for scratching a lottery ticket scratch-off assembly.

The downwardly-tapered front surface and downwardly-tapered back surface comprise the tool for scratching a lottery ticket scratch-off assembly. The downwardly-tapered front surface is mated to the downwardly-tapered back surface via injection molding. The tool for scratching a lottery ticket scratch-off assembly is approximately 1¾ inches in height. The tool for scratching a lottery ticket scratch-off assembly is approximately ⅞ inches in width. The tapered back bottom portion having the tapered blade of the tool for scratching a lottery ticket scratch-off assembly is approximately ⅜ inches in thickness. The tool for scratching a lottery ticket scratch-off assembly comprises an injection-molded thermoplastic polymer to provide strength, durability, and lack of deformability.

The front top portion, the front central portion, and the tapered front bottom portion comprise the downwardly-tapered front surface. The back top portion, the back central portion, and the tapered back bottom portion comprise the downwardly-tapered back surface. The at least one aperture located on the front top portion is centrally located along an upper edge of the top portion. The aperture acts as a keychain aperture for inserting a ball-clasp chain through the aperture thereby removably-coupling the tool for scratching a lottery ticket scratch-off assembly to a keychain of a user-scratcher so as to have access to the tool for scratching a lottery ticket scratch-off assembly thereby preventing unwanted displacement of the tool for scratching a lottery ticket scratch-off assembly.

The digit-contoured indented center provides a region for the digit of a user-scratcher to grasp the tool for scratching lottery tickets system, thereby preventing unwanted displacement while in an in-use condition. The digit-contoured indented center is deformable. The light, when included, comprises at least one LED. The LED light is activated by compressing the deformable digit-contoured indented center. The LED light is powered via at least one battery. The at least one battery comprises a long-life, internal lithium-ion pill-type battery. The light when activated by compressing the digit-contoured indented center illuminates a keyhole on a doorknob when user-scratcher removably-couples the tool for scratching a lottery ticket scratch-off assembly to the keychain. The at least one light illuminates an area around the lottery scratch off ticket.

At least one front-side tapered blade is integral to the at least one back-side tapered blade thereby forming the tapered blade. The tapered blade when engaged with the lottery ticket scratch-off removes at least one opaque film thereby revealing if a prize is won. The opaque substance may comprise latex. The tool for scratching a lottery ticket scratch-off assembly is structured and arranged for quickly and cleanly scratching off the opaque film on scratch-off the lottery tickets.

A kit is also embodied herein for the tool for scratching a lottery ticket scratch-off system comprising at least: a plurality of tools for scratching a lottery ticket scratch-off assemblies in various colors, designs, logos, graphics, and indicias, an optional replaceable long-life, internal lithium-ion pill-type battery; and a set of user-instructions.

A method of using a tool for scratching a lottery ticket scratch-off system is disclosed herein comprising the steps of: purchasing a user-preferred scratch off lottery ticket; choosing a tool for scratching a lottery ticket scratch-off assembly in a user-preferred color and design; a user-scratcher grasping the tool for scratching a lottery ticket scratch-off assembly; compressing a digit-contoured indented center located on tool for scratching a lottery ticket scratch-off assembly; activating at least one LED light; illuminating an area surrounding the scratch off lottery ticket; a user-scratcher scratching off the opaque substance via at least one tapered blade; decompressing the digit-contoured indented center; de-activating the LED light once completely removing all opaque substance on the scratch off lottery ticket; and discarding the scratch off lottery ticket.

The present invention holds significant improvements and serves as a tool for scratching a lottery ticket scratch-off system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, tool for scratching a lottery ticket scratch-off system (entitled EZ Scratch Systems) constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a lottery ticket scratcher device and more particularly to a tool for scratching a lottery ticket scratch-off system (entitled 'EZ Scratch Systems') that is structured and arranged for quickly and cleanly scratching off an opaque film on scratch-off lottery tickets.

Generally speaking, EZ Scratch Systems comprises a keychain fob specifically designed for use in scraping away the opaque film on scratch-off lottery tickets. Compact, convenient, and even including its own pressure-activated reading light, the EZ Scratch Systems may cost less than half the price of a $5 scratch-off ticket, and preferably provide users with a quick and effective means of finding out whether this is their lucky day.

Fabricated in a preferably tough and durable injection-molded thermoplastic polymer or metal, the EZ Scratch Systems may be about the size and dimensions of a book of matches for easy handling and use, measuring approximately 1¾ inches in height, by ⅞-inch in width, and tapering from a top about ⅜-inch in thickness to a bottom that tapers to a thin-edged scraping blade. The center top of the EZ Scratch Systems may be equipped with a keychain hole (and perhaps a ball-clasp chain or a split-ring), and the center of the device may be equipped with a thumb-press LED light—this light powered by a long-life, internal lithium-ion pill-type battery, and providing instant illumination useful not only for reading the numbers or symbols of the lottery ticket, but also for use when the EZ Scratch Systems is employed as a keychain: illuminating a doorknob keyhole at night, for example.

The EZ Scratch Systems may be produced in a wide variety of colors, and could also be imprinted or emblazoned with a variety of sports-team logos; lucky sayings or mottos, and other graphics or language designed to appeal to individual users, from "World's Greatest Dad," for example, to "You Go, Girl," to "Bring Home the Bling."

The EZ Scratch Systems may offer consumers a simple, convenient, handy, and effective tool for quickly and cleanly scratching off the concealing film on scratch-off lottery tickets and a tool that may double as a lighted keychain. The lighted keychain may be used as a guide when unlocking doors, or simply while viewing scratch off tickets, or other reading materials, in a dimly lit area.

The EZ Scratch Systems is clever in conception, thoughtful in design, and sure to appeal strongly to tens of millions of Americans who play scratch-off lottery games. The EZ Scratch Systems may be sold in displays on the very convenience stores where most consumers buy their tickets. Convenient and readily accessible and available, the EZ Scratch Systems may not improve an individual's chances in the lottery, but as an invention, presents itself as a clear winner.

Figure 1:
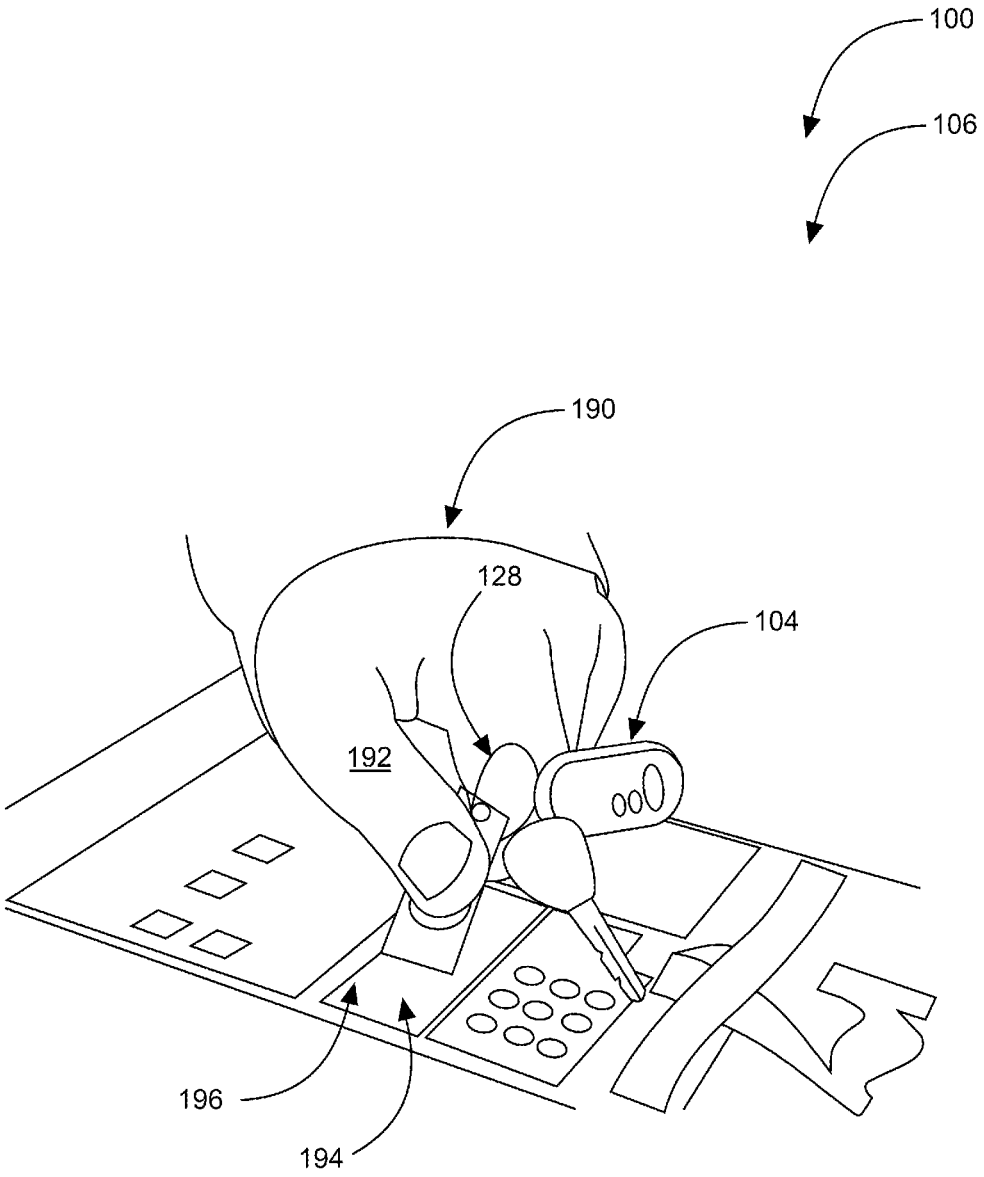
FIG. 1 shows a perspective view illustrating a tool for scratching a lottery ticket scratch-off system in an in-use condition according to an embodiment of the present invention.
Figure 2:
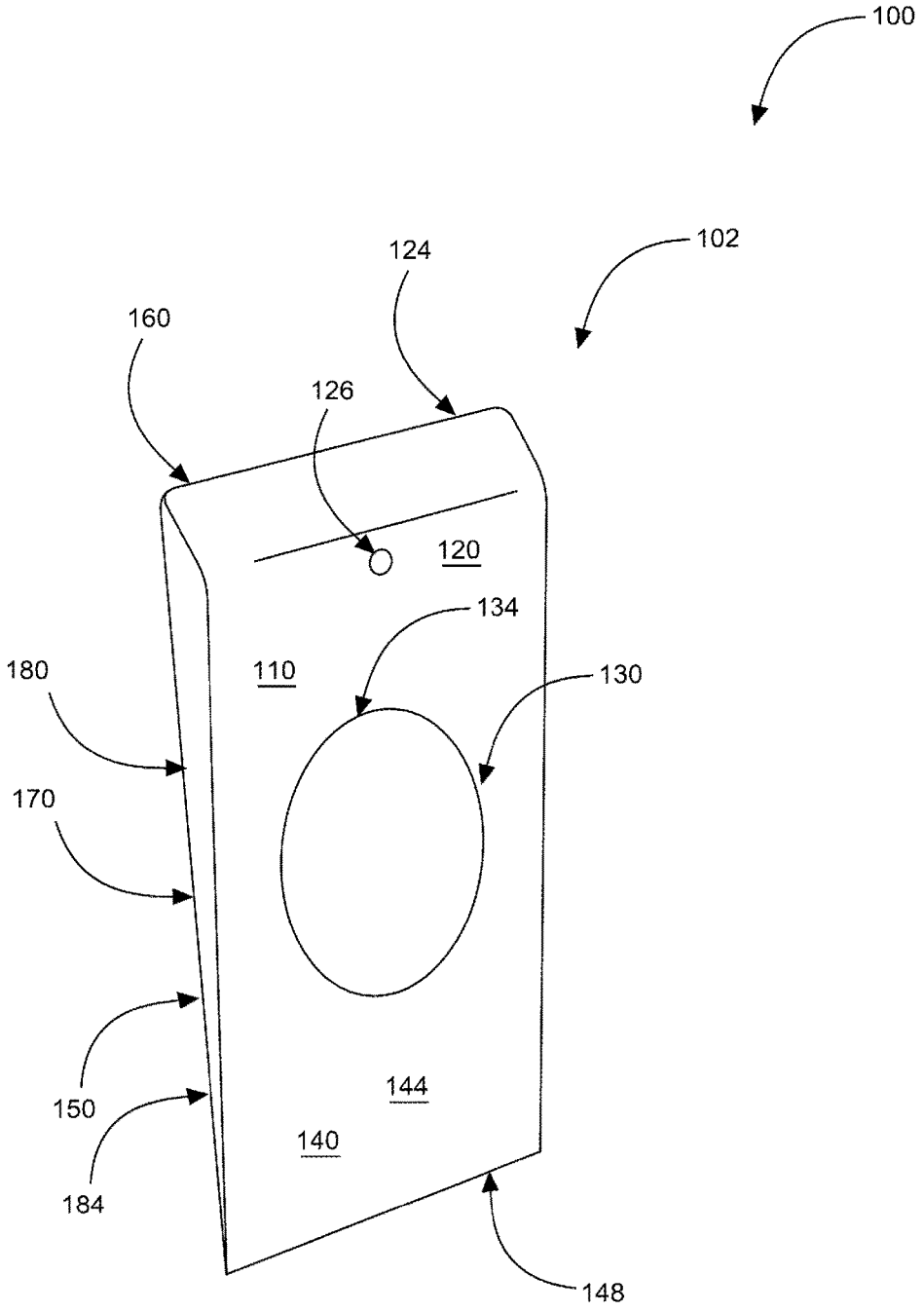
FIG. 2 is a front perspective view illustrating a tool for scratching a lottery ticket scratch-off assembly of the tool for scratching a lottery ticket scratch-off system according to an embodiment of the present invention of FIG. 1.
Figure 3:
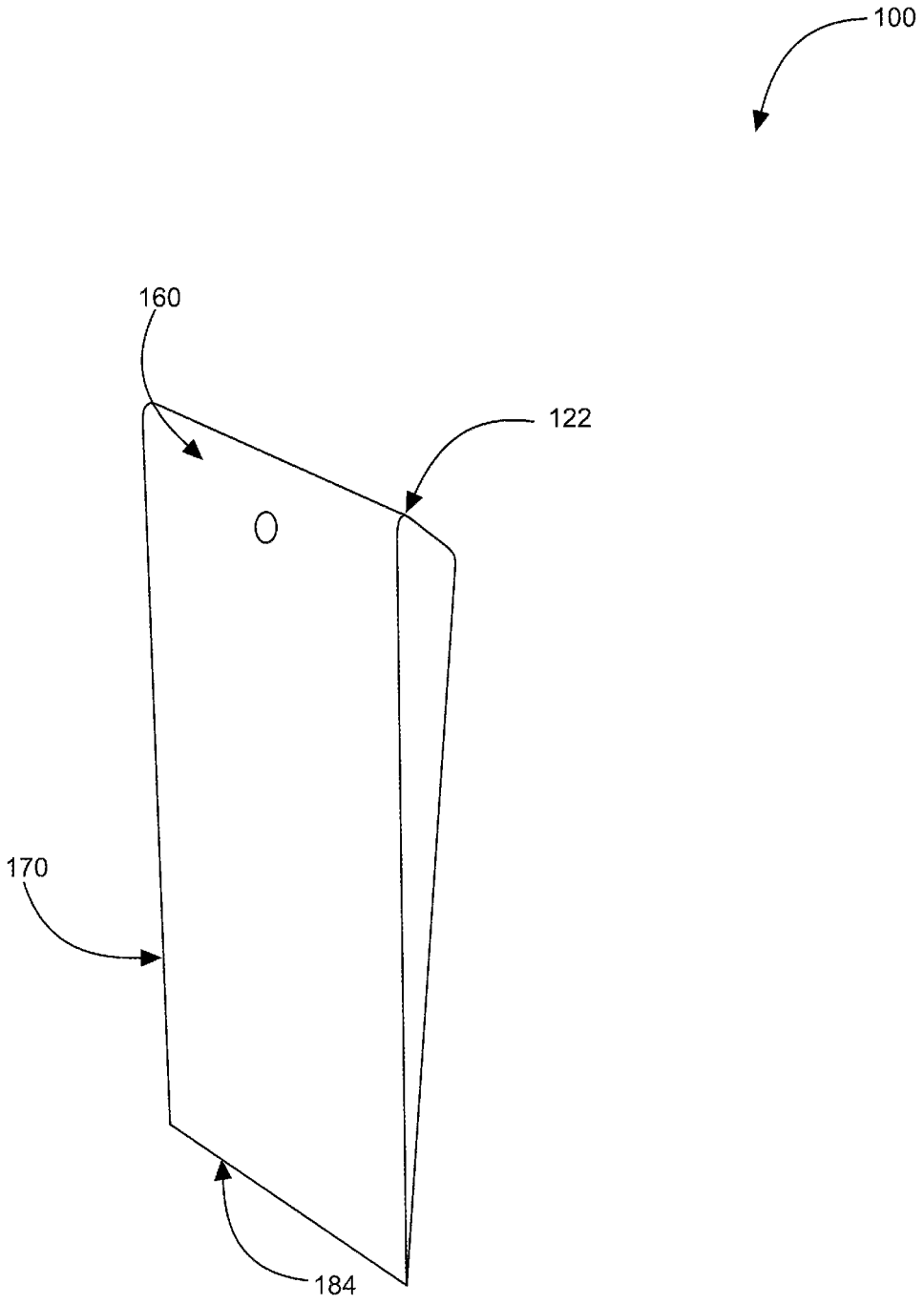
FIG. 3 is a back perspective view illustrating a tool for scratching a lottery ticket scratch-off assembly of the tool for scratching a lottery ticket scratch-off system according to an embodiment of the present invention of FIG. 1.

Referring now to the drawings by numerals of reference there is shown in FIGS. 1-3 perspective views illustrating tool for scratching a lottery ticket scratch-off assembly 102 of tool for scratching a lottery ticket scratch-off system 100 according to an embodiment of the present invention.

Tool for scratching a lottery ticket scratch-off system 100 comprises tool for scratching a lottery ticket scratch-off assembly 102 having downwardly-tapered front surface 110 having front top portion 120 including upwardly-curved lip 122, and at least one aperture 126, front central portion 130 having digit-contoured indented center 134 having at least one optional light 136, and tapered front bottom portion 140 having at least one front-side tapered blade 144; and downwardly-tapered back surface 150 having back top portion 160, back central portion 170, and tapered back bottom portion 180 having at least one back-side tapered blade 184. Tool for scratching a lottery ticket scratch-off system 100 preferably comprises tool for scratching a lottery ticket scratch-off assembly 102.

Downwardly-tapered front surface 110 and the downwardly-tapered back surface 150 comprise tool for scratching a lottery ticket scratch-off assembly 110. Back top portion 160, back central portion 170, and tapered back bottom portion 180 comprise downwardly-tapered back surface 150. Downwardly-tapered front surface 110 is mated to downwardly-tapered back surface 150 via injection molding. Tool for scratching a lottery ticket scratch-off assembly 102 is approximately 1¾ inches in height. Tool for scratching a lottery ticket scratch-off assembly 102 is approximately ⅞ inches in width. Tapered back bottom portion 180 having tapered blade 184 of tool for scratching a lottery ticket scratch-off assembly 102 is approximately ⅜ inches in thickness.

Tool for scratching a lottery ticket scratch-off assembly 102 comprises an injection-molded thermoplastic polymer to provide strength, durability, and lack of deformability. Upon reading this specification, it should be appreciated that, under appropriate circumstances, considering such issues as user preferences, design preference, structural requirements, marketing preferences, cost, available materials, technological advances, etc., other material arrangements such as, for example, ferrous and non-ferrous materials including cast-molded metal, etc., may be sufficient.

Front top portion 120, front central portion 130, and tapered front bottom portion 140 comprise downwardly-tapered front surface 110. At least one aperture 126 located on front top portion 120 is centrally located along upper edge 124 of top portion 120. Aperture 126 acts as a keychain aperture for inserting ball-clasp chain 128 through aperture 126 thereby removably-coupling tool for scratching a lottery ticket scratch-off assembly 102 to keychain 104 of user-scratcher 190 so as to have access to tool for scratching a lottery ticket scratch-off assembly 102 thereby preventing unwanted displacement of tool for scratching a lottery ticket scratch-off assembly 102 as shown in in-use condition 106 of FIG. 1. Upon reading this specification, it should be appreciated that, under appropriate circumstances, considering such issues as user preferences, design preference, structural requirements, marketing preferences, cost, available materials, technological advances, etc., other keychain fastener arrangements such as, for example, a split ring, a carbineer, etc., may be sufficient.

Digit-contoured indented center 134 provides a region for digit 192 of user-scratcher 190 to grasp tool for scratching lottery tickets system 100, thereby preventing unwanted displacement while in in-use condition 106. Digit-contoured indented center 134 is deformable. Light 136 preferably comprises at least one LED, however other lighting means may be suitably used. The LED light 136 is activated by compressing deformable digit-contoured indented center 134. LED light 136 is powered via at least one battery. The at least one battery comprises a long-life, internal lithium-ion pill-type battery. Light 136 when activated by compressing digit-contoured indented center 134 illuminates a keyhole on a doorknob when user-scratcher 190 removably-couples tool for scratching a lottery ticket scratch-off assembly 102 to keychain 104. At least one light 136 illuminates an area around lottery scratch off ticket 194.

At least one front-side tapered blade 144 is integral to at least one back-side tapered blade 184 thereby forming tapered blade 148. Tapered blade 148 when engaged lottery ticket scratch-off 194 removes at least one opaque film 196 thereby revealing if a prize is won. Opaque film 196 preferably comprises latex, however other substances may be suitably used. Tool for scratching a lottery ticket scratch-off assembly 102 is structured and arranged for quickly and cleanly scratching off opaque film 196 on scratch-off lottery tickets 194.

Figure 4:
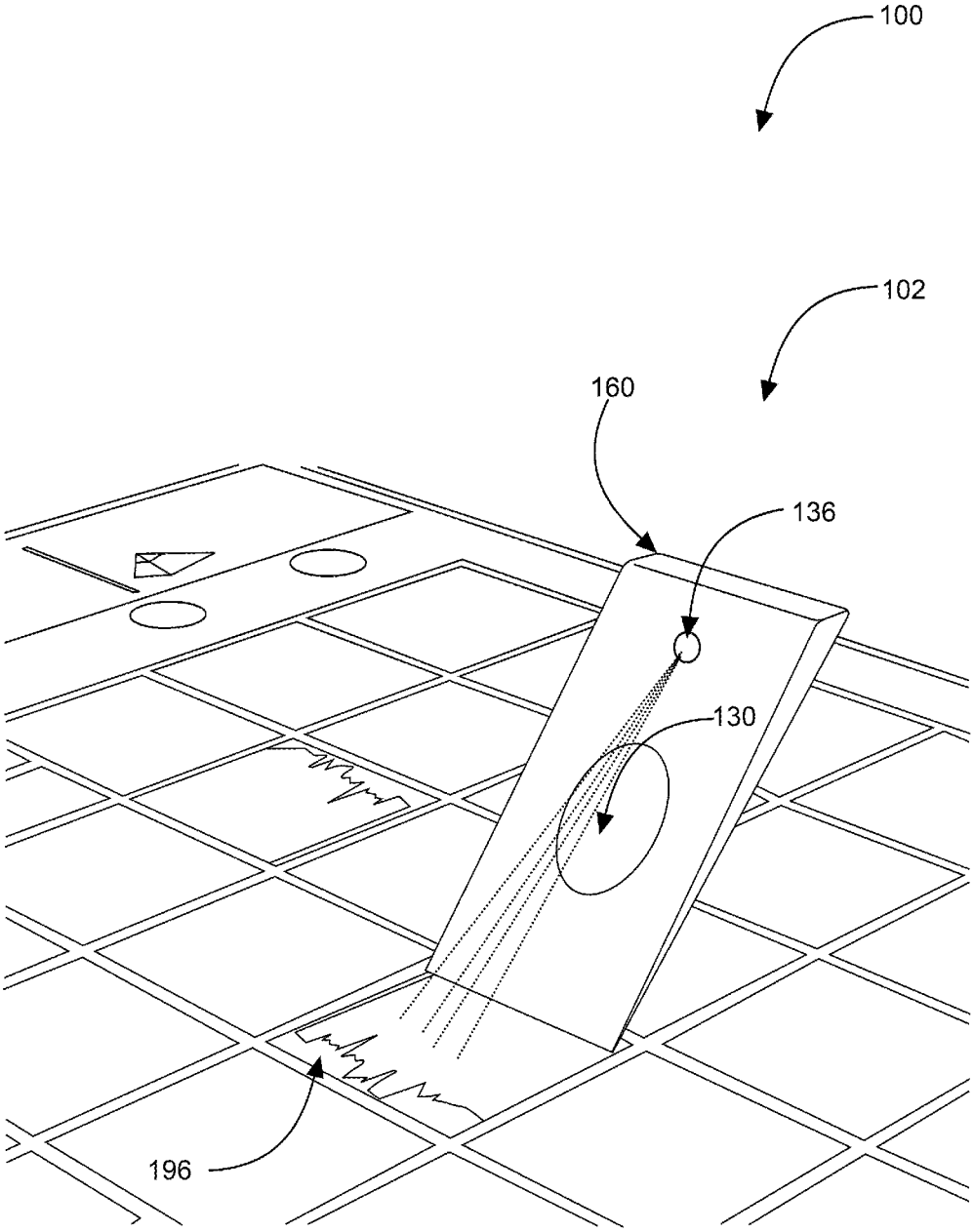
FIG. 4 is a perspective view illustrating a kit of the tool for scratching a lottery ticket scratch-off system system according to an embodiment of the present invention.

Referring now to FIG. 4 showing a perspective view illustrating kit 400 of tool for scratching a lottery ticket scratch-off system 100 according to an embodiment of the present invention of FIG. 1

Kit 400 is embodied herein for tool for scratching a lottery ticket scratch-off system 100 comprising a plurality of tool for scratching a lottery ticket scratch-off assemblies 102 in various colors, designs, logos, graphics, and indicias, an optional replaceable long-life, internal lithium-ion pill-type battery; and set of user-instructions 410.

The kit has instructions such that functional relationships are detailed in relation to the structure of the invention (such that the invention can be used, maintained, or the like in a preferred manner). Tool for scratching a lottery ticket scratch-off system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different scratch surface/means and combinations, parts may be sold separately, etc., may be sufficient.

Figure 5:
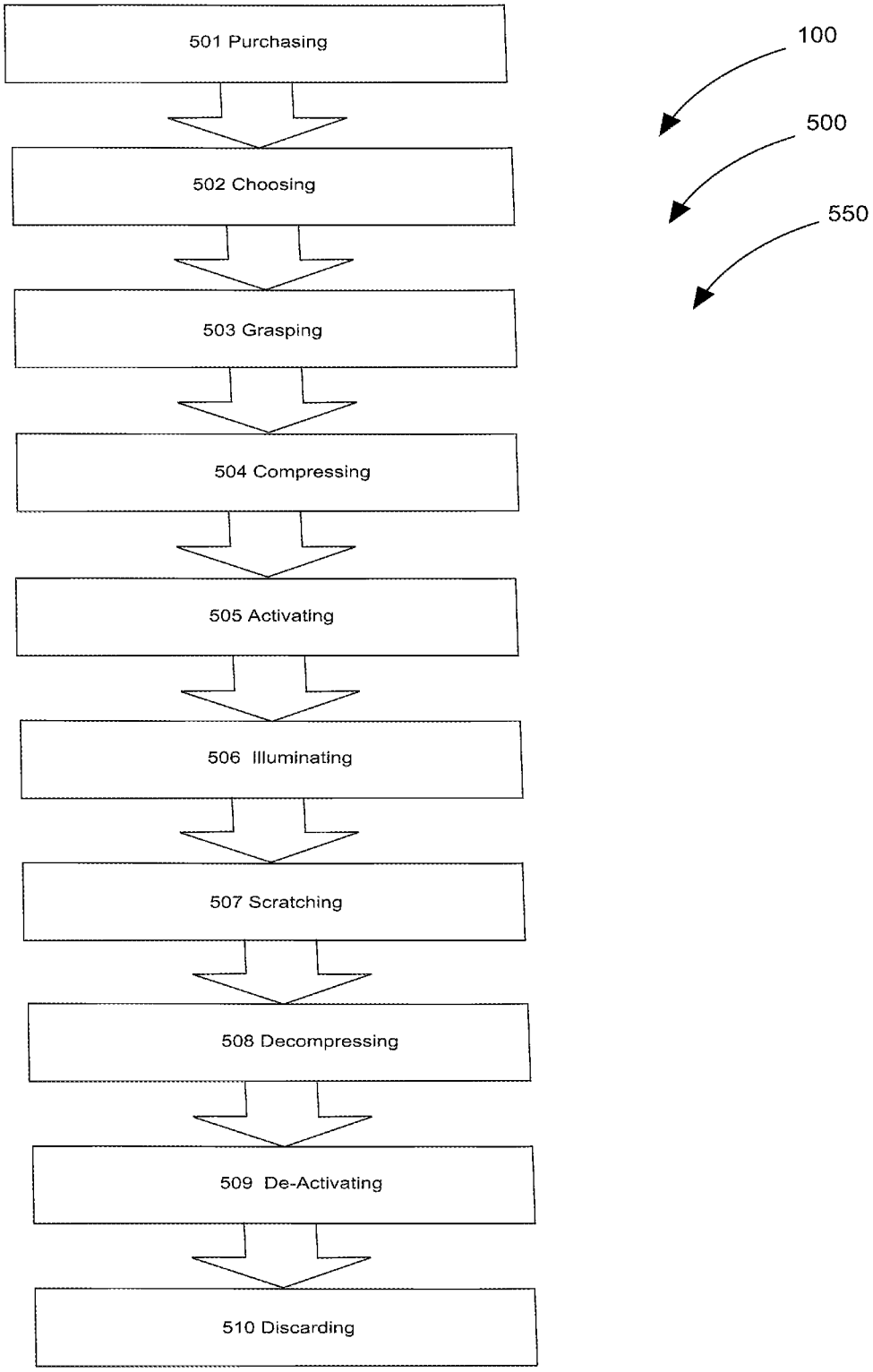
FIG. 5 is a flowchart illustrating a method of use for the tool for scratching a lottery ticket scratch-off system according to an embodiment of the present invention of FIGS. 1-4.

Referring now to FIG. 5, flowchart 550 illustrating method of use 500 for tool for scratching a lottery ticket scratch-off system 100 according to an embodiment of the present invention of FIGS. 1-4.

Method of using (method of use 500) tool for scratching a lottery ticket scratch-off system 100 comprises the steps of: step one 501 purchasing a user-preferred scratch off lottery ticket 194; step two 502 choosing tool for scratching a lottery ticket scratch-off assembly 102 in a user-preferred color and design; step three 503 user-scratcher 190 grasping tool for scratching a lottery ticket scratch-off assembly 102; step four 504 compressing digit-contoured indented center 134 located on tool for scratching a lottery ticket scratch-off assembly 102; step five 505 activating at least one LED light 136; step six 506 illuminating an area surrounding scratch off lottery ticket 194; step seven 507 user-scratcher 190 scratching off opaque film 196 via at least one tapered blade 148; step eight 508 decompressing digit-contoured indented center 134; step nine 509 de-activating LED light 136 once completely removing all opaque film 196 on scratch off lottery ticket 194; and step ten 510 discarding scratch off lottery ticket 194.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A tool for scratching a lottery ticket scratch-off system comprising:

a tool for scratching a lottery ticket scratch-off assembly having, a downwardly-tapered front surface having, a front top portion having an upwardly-curved lip, a front central portion having, a digit-contoured indented center, and a tapered front bottom portion having, at least one front-side tapered blade; and a downwardly-tapered back surface having, a back top portion, a back central portion, and a tapered back bottom portion having, at least one back-side tapered blade;

wherein said tool for scratching a lottery ticket scratch-off system comprises said tool for scratching a lottery ticket scratch-off assembly;

wherein said downwardly-tapered front surface and said downwardly-tapered back surface comprise said tool for scratching a lottery ticket scratch-off assembly;

wherein said downwardly-tapered front surface is mated to said downwardly-tapered back surface via injection molding;

wherein said front top portion, said front central portion, and said tapered front bottom portion comprise said downwardly-tapered front surface;

wherein said back top portion, said back central portion, and said tapered back bottom portion comprise said downwardly-tapered back surface;

wherein said at least one front-side tapered blade is integral to said at least one back-side tapered blade thereby forming said tapered blade;

wherein said tapered blade when engaged with said lottery ticket scratch-off removes at least one opaque film thereby revealing if a prize is won;

wherein said digit-contoured indented center provides a region for said digit of a user-scratcher to grasp said tool for scratching lottery tickets system, thereby preventing unwanted displacement while in an in-use condition; and wherein said tool for scratching a lottery ticket scratch-off assembly is structured and arranged for quickly and cleanly scratching off said opaque film on scratch-off said lottery tickets.

2. The tool for scratching a lottery ticket scratch-off system of claim 1 wherein said tool for scratching a lottery ticket scratch-off assembly comprises an injection-molded thermoplastic polymer to provide strength, durability, and lack of deformability.

3. The tool for scratching a lottery ticket scratch-off system of claim 1 wherein said tool for scratching a lottery ticket scratch-off assembly comprises a cast-molded metal to provide strength, durability, and lack of deformability.

4. The tool for scratching a lottery ticket scratch-off system of claim 1 wherein said tool for scratching a lottery ticket scratch-off assembly is approximately 1¾ inches in height.

5. The tool for scratching a lottery ticket scratch-off system of claim 1 wherein said tool for scratching a lottery ticket scratch-off assembly is approximately ⅞ inches in width.

6. The tool for scratching a lottery ticket scratch-off system of claim 1 wherein said tapered back bottom portion having said tapered blade of said tool for scratching a lottery ticket scratch-off assembly is approximately ⅜ inches in thickness.

7. The tool for scratching a lottery ticket scratch-off system of claim 1 wherein said opaque film comprises latex.

8. The tool for scratching a lottery ticket scratch-off system of claim 1 wherein said front top portion of said tool for scratching a lottery ticket scratch-off assembly further comprises at least one aperture centrally located along an upper edge of said top portion.

9. The tool for scratching a lottery ticket scratch-off system of claim 8 where said aperture acts as a keychain aperture for inserting a ball-clasp chain through said aperture thereby removably-coupling said tool for scratching a lottery ticket scratch-off assembly to a keychain of a user-scratcher so as to have access to said tool for scratching a lottery ticket scratch-off assembly thereby preventing unwanted displacement of said tool for scratching a lottery ticket scratch-off assembly.

10. The tool for scratching a lottery ticket scratch-off system of claim 8 where said aperture acts as a keychain aperture for inserting a split-ring through said aperture thereby removably-coupling said tool for scratching a lottery ticket scratch-off assembly to a keychain of a user-scratcher so as to have access to said tool for scratching a lottery ticket scratch-off assembly thereby preventing unwanted displacement of said tool for scratching a lottery ticket scratch-off assembly.

11. The tool for scratching a lottery ticket scratch-off system of claim 1 wherein said digit-contoured indented center is deformable.

12. The tool for scratching a lottery ticket scratch-off system of claim 11 further comprises at least one light for illuminating an area around said lottery scratch off ticket.

13. The tool for scratching a lottery ticket scratch-off system of claim 12 wherein said light comprises at least one LED.

14. The tool for scratching a lottery ticket scratch-off system of claim 13 wherein said LED light is activated by compressing said deformable said digit-contoured indented center.

15. The tool for scratching a lottery ticket scratch-off system of claim 14 wherein said LED light is powered via at least one battery.

16. The tool for scratching a lottery ticket scratch-off system of claim 14 wherein said at least one battery comprises a long-life, internal lithium-ion pill-type battery.

17. The tool for scratching a lottery ticket scratch-off system of claim 14 wherein said light when activated by compressing said digit-contoured indented center illuminates a keyhole on a doorknob when user-scratcher removably-couples said tool for scratching a lottery ticket scratch-off assembly to said keychain.

18. A tool for scratching a lottery ticket scratch-off system comprising:

a tool for scratching a lottery ticket scratch-off assembly having,
- a downwardly-tapered front surface having,
  - a front top portion having
    - an upwardly-curved lip, and
    - at least one aperture;
  - a front central portion having,
    - a digit-contoured indented center having at least one light, and
  - a tapered front bottom portion having,
    - at least one front-side tapered blade; and
- a downwardly-tapered back surface having,
  - a back top portion,
  - a back central portion, and
  - a tapered back bottom portion having,
    - at least one back-side tapered blade;

wherein said tool for scratching a lottery ticket scratch-off system comprises said tool for scratching a lottery ticket scratch-off assembly;

wherein said downwardly-tapered front surface and said downwardly-tapered back surface comprise said tool for scratching a lottery ticket scratch-off assembly;

wherein said downwardly-tapered front surface is mated to said downwardly-tapered back surface via injection molding;

wherein said tool for scratching a lottery ticket scratch-off assembly comprises an injection-molded thermoplastic polymer to provide strength, durability, and lack of deformability;

wherein said tool for scratching a lottery ticket scratch-off assembly is approximately 1¾ inches in height;

wherein said tool for scratching a lottery ticket scratch-off assembly is approximately ⅞ inches in width;

wherein said tapered back bottom portion having said tapered blade of said tool for scratching a lottery ticket scratch-off assembly is approximately ⅜ inches in thickness;

wherein said front top portion, said front central portion, and said tapered front bottom portion comprise said downwardly-tapered front surface;

wherein of said at least one aperture located on said front top portion is centrally located along an upper edge of said top portion;

where said aperture acts as a keychain aperture for inserting a ball-clasp chain through said aperture thereby removably-coupling said tool for scratching a lottery ticket scratch-off assembly to a keychain of a user-scratcher so as to have access to said tool for scratching a lottery ticket scratch-off assembly thereby preventing unwanted displacement of said tool for scratching a lottery ticket scratch-off assembly;

wherein said digit-contoured indented center provides a region for said digit of a user-scratcher to grasp said tool for scratching lottery tickets system, thereby preventing unwanted displacement while in an in-use condition;

wherein said digit-contoured indented center is deformable;

wherein said light comprises at least one LED;

wherein said LED light is activated by compressing said deformable said digit-contoured indented center;

wherein said LED light is powered via at least one battery;

wherein said at least one battery comprises a long-life, internal lithium-ion pill-type battery;

wherein said light when activated by compressing said digit-contoured indented center illuminates a keyhole on a doorknob when user-scratcher removably-couples said tool for scratching a lottery ticket scratch-off assembly to said keychain;

wherein said back top portion, said back central portion, and said tapered back bottom portion comprise said downwardly-tapered back surface;

wherein said at least one light illuminates an area around said lottery scratch off ticket;

wherein said at least one front-side tapered blade is integral to said at least one back-side tapered blade thereby forming said tapered blade;

wherein said tapered blade when engaged with said lottery ticket scratch-off removes at least one opaque film thereby revealing if a prize is won;

wherein said opaque film comprises latex; and wherein said tool for scratching a lottery ticket scratch-off assembly is structured and arranged for quickly and cleanly scratching off said opaque film on scratch-off said lottery tickets.

19. The tool for scratching a lottery ticket scratch-off system of claim 18 further comprising a kit including: a plurality of said tool for scratching a lottery ticket scratch-off assemblies in various colors, designs, logos, graphics, and indicias; and a set of user-instructions.

* * * * *